US010789969B1

(12) United States Patent
Long et al.

(10) Patent No.: US 10,789,969 B1
(45) Date of Patent: Sep. 29, 2020

(54) AUDIO SIGNAL NOISE ESTIMATION METHOD AND DEVICE, AND STORAGE MEDIUM

(71) Applicant: BEIJING XIAOMI MOBILE SOFTWARE CO., LTD., Beijing (CN)

(72) Inventors: Taochen Long, Beijing (CN); Haining Hou, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 0 days.

(21) Appl. No.: 16/694,543

(22) Filed: Nov. 25, 2019

(30) Foreign Application Priority Data

Aug. 15, 2019 (CN) ..... 2019 1 0755626

(51) Int. Cl.

| | |
|---|---|
| ***G10L 21/0232*** | (2013.01) |
| ***H04R 1/40*** | (2006.01) |
| ***H04R 3/00*** | (2006.01) |
| *G10L 21/0216* | (2013.01) |

(52) U.S. Cl.
CPC ..... *G10L 21/0232* (2013.01); *H04R 1/406* (2013.01); *H04R 3/005* (2013.01); *G10L 2021/02166* (2013.01); *H04R 2201/401* (2013.01); *H04R 2201/403* (2013.01)

(58) Field of Classification Search
None
See application file for complete search history.

(56) References Cited

U.S. PATENT DOCUMENTS

2013/0315403 A1 11/2013 Samuelsson
2015/0055797 A1* 2/2015 Nguyen ..... H04R 3/005 381/92
2015/0364137 A1 12/2015 Katuri et al.
2017/0078791 A1 3/2017 Samuelsson
2017/0337932 A1* 11/2017 Iyengar ..... G10L 21/0208
2018/0033447 A1* 2/2018 Ramprashad ..... G10L 21/0216
2018/0322896 A1 11/2018 Tanaka et al.
2018/0374469 A1* 12/2018 Hutchinson ..... G10K 11/17857
2020/0107118 A1* 4/2020 Salehin ..... H04S 3/02

FOREIGN PATENT DOCUMENTS

CN 109308908 A 2/2019

OTHER PUBLICATIONS

Supplementary European Search Report in the European application No. 19214646.2, dated Mar. 27, 2020.

* cited by examiner

*Primary Examiner* — Paul W Huber
(74) *Attorney, Agent, or Firm* — Syncoda LLC; Feng Ma

(57) ABSTRACT

An audio signal noise estimation method includes: for multiple preset sampling points, a noise Steered Response Power (SRP) value of a Microphone (MIC) array at each preset sampling point within a preset noise sampling period is determined to obtain a noise SRP multidimensional vector including the multiple noise SRP values corresponding to the multiple preset sampling points; a present frame SRP value for a present frame of an audio signal acquired by the MIC array at each preset sampling point is determined to obtain a present frame SRP multidimensional vector including the multiple present frame SRP values corresponding to the multiple preset sampling points; and whether the audio signal acquired by the MIC array in the present frame is a noise signal is determined according to the present frame SRP multidimensional vector and the noise SRP multidimensional vector.

20 Claims, 8 Drawing Sheets

AUDIO SIGNAL NOISE ESTIMATION METHOD AND DEVICE, AND STORAGE MEDIUM

CROSS-REFERENCE TO RELATED APPLICATION

This application claims priority to Chinese patent application No. 201910755626.6 filed on Aug. 15, 2019, the disclosure of which is hereby incorporated by reference in its entirety.

BACKGROUND

Along with development of the Internet of Things (IoT) and Artificial Intelligence (AI) technologies, voice recognition, as a major part of human-machine interaction, has become increasingly important. At present, a pickup or sound collection function of a smart device is usually realized by using a Microphone (MIC) array, and processing quality for audio signal is improved by using a beamforming technology.

SUMMARY

The present disclosure generally relates to the field of voice recognition, and more particularly, to an audio signal noise estimation method and device, and a storage medium.

According to a first aspect of embodiments of the present disclosure, an audio signal noise estimation method is provided, which can be applied to a MIC array including multiple MICs and include the following operations that: a noise steered response power (SRP) value of an audio signal acquired by the MIC array at each preset sampling point within a preset noise sampling period is determined for multiple preset sampling points to obtain a noise SRP multidimensional vector including the multiple noise SRP values, each of the multiple noise SRP values corresponding to a respective one of the multiple preset sampling points; a present frame SRP value for a present frame of an audio signal acquired by the MIC array at each preset sampling point is determined to obtain a present frame SRP multidimensional vector including the multiple present frame SRP values, each of the multiple present frame SRP values corresponding to a respective one of the multiple preset sampling points; and it is determined whether an audio signal acquired by the MIC array in the present frame is a noise signal according to the present frame SRP multidimensional vector and the noise SRP multidimensional vector.

In some embodiments, after the operation that whether the audio signal acquired by the MIC array in the present frame is a noise signal is determined, the method may further include that: the noise SRP multidimensional vector is updated according to the present frame SRP multidimensional vector.

In some embodiments, the operation that the noise SRP multidimensional vector is updated according to the present frame SRP multidimensional vector may include that: responsive to determining that the audio signal acquired by the MIC array in the present frame is a noise signal, the noise SRP multidimensional vector is updated according to the present frame SRP multidimensional vector and a first preset coefficient; and responsive to determining that the audio signal acquired by the MIC array in the present frame is a non-noise signal, the noise SRP multidimensional vector is updated according to the present frame SRP multidimensional vector and a second preset coefficient, the second preset coefficient being different from the first preset coefficient.

In some embodiments, the operation that the noise SRP multidimensional vector is updated according to the present frame SRP multidimensional vector and the first preset coefficient may include that: the noise SRP multidimensional vector is updated according to the following formula (1):

$$\text{SRP_noise}(t+1)=(1-\gamma_1)*\text{SRP_noise}(t)+\gamma_1*\text{SRP_cur} \quad (1)$$

where γ1 may be the first preset coefficient, SRP_cur may be the present frame SRP multidimensional vector, SRP_noise(t) may be the noise SRP multidimensional vector before updating, and SRP_noise(t+1) may be the updated noise SRP multidimensional vector.

In some embodiments, the operation that the noise SRP multidimensional vector is updated according to the present frame SRP multidimensional vector and the second preset coefficient may include that: the noise SRP multidimensional vector is updated according to the following formula (2):

$$\text{SRP_noise}(t+1)=(1-\gamma_2)*\text{SRP_noise}(t)+\gamma_2*\text{SRP_cur} \quad (2)$$

where γ2 may be the second preset coefficient, SRP_cur may be the present frame SRP multidimensional vector, SRP_noise(t) may be the noise SRP multidimensional vector before updating, and SRP_noise(t+1) may be the updated noise SRP multidimensional vector.

According to a second aspect of the embodiments of the present disclosure, an audio signal noise estimation device is provided, which can be applied to a MIC array including multiple MICs and include: a first determination portion, configured to determine, for multiple preset sampling points, a noise SRP value of an audio signal acquired by the MIC array at each preset sampling point within a preset noise sampling period to obtain a noise SRP multidimensional vector including the multiple noise SRP values, each of the multiple noise SRP values corresponding to a respective one of the multiple preset sampling points; a second determination portion, configured to determine a present frame SRP value for a present frame of an audio signal acquired by the MIC array at each preset sampling point to obtain a present frame SRP multidimensional vector including the multiple present frame SRP values, each of the multiple present SRP values corresponding to a respective one of the multiple preset sampling points; and a third determination portion, configured to determine whether an audio signal acquired by the MIC array in the present frame is a noise signal according to the present frame SRP multidimensional vector and the noise SRP multidimensional vector.

According to a third aspect of the embodiments of the present disclosure, an audio signal noise estimation device is provided, which can include: a processor; and a memory configured to store an instruction executable by the processor. The processor can be configured to: determine, for multiple preset sampling points, a noise SRP value of an audio signal acquired by the MIC array at each preset sampling point within a preset noise sampling period to obtain a noise SRP multidimensional vector including the multiple noise SRP values, each of the multiple noise SRP values corresponding to a respective one of the multiple preset sampling points; determine a present frame SRP value for a present frame of an audio signal acquired by the MIC array at each preset sampling point to obtain a present frame SRP multidimensional vector including the multiple present frame SRP values, each of the multiple present frame SRP values corresponding to a respective one of the multiple preset sampling points; and determine whether the audio signal acquired by the MIC array in the present frame is a noise signal according to the present frame SRP multidimensional vector and the noise SRP multidimensional vector.

According to a fourth aspect of the embodiments of the present disclosure, a computer-readable storage medium is provided, which has a computer program instruction stored thereon. The program instruction, when being executed by a processor, causes the processor to implement the audio signal noise estimation method provided according to the first aspect of the present disclosure.

It is to be understood that the above general descriptions and detailed descriptions below are only exemplary and explanatory and not intended to limit the present disclosure.

BRIEF DESCRIPTION OF THE DRAWINGS

The accompanying drawings referred to in the specification are a part of this disclosure, and provide illustrative embodiments consistent with the disclosure and, together with the detailed description, serve to illustrate some embodiments of the disclosure.

DETAILED DESCRIPTION

Figure 1:
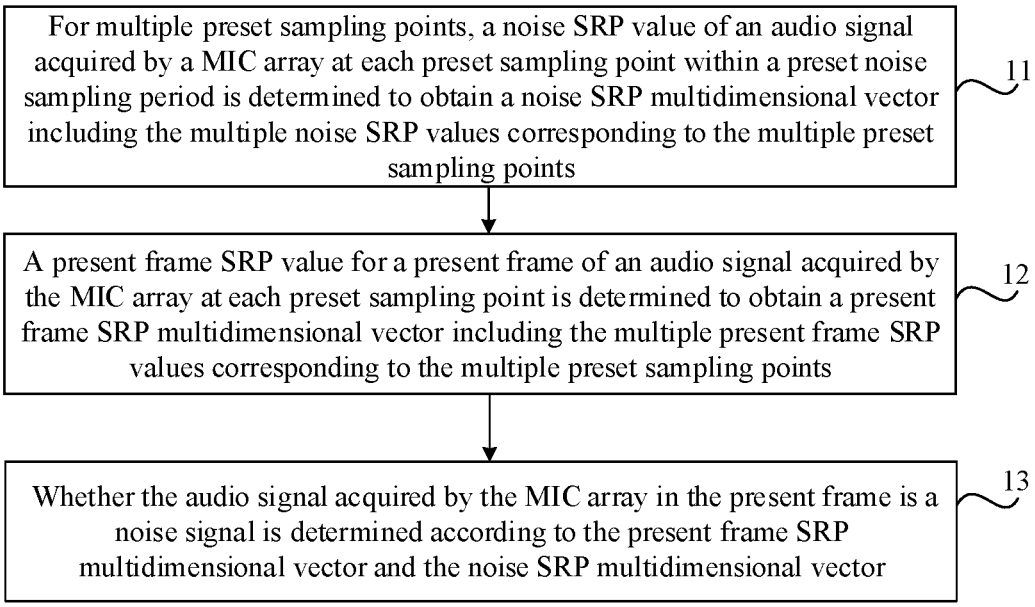
FIG. 1 is a flowchart illustrating an audio signal noise estimation method according to some embodiments of the present disclosure.

Exemplary embodiments (examples of which are illustrated in the accompanying drawings) are elaborated below. The following description refers to the accompanying drawings, in which identical or similar elements in two drawings are denoted by identical reference numerals unless indicated otherwise. The exemplary implementation modes may take on multiple forms, and should not be taken as being limited to examples illustrated herein. Instead, by providing such implementation modes, embodiments herein may become more comprehensive and complete, and comprehensive concept of the exemplary implementation modes may be delivered to those skilled in the art. Implementations set forth in the following exemplary embodiments do not represent all implementations in accordance with the subject disclosure. Rather, they are merely examples of the apparatus and method in accordance with certain aspects herein as recited in the accompanying claims.

In a voice recognition technology, noise estimation can be adopted as a basis for noise suppression and interference suppression. Currently, the noise estimation technology is generally accurate only for processing of the single-channel audio signals acquired by a single MIC, and it may be difficult to process multichannel audio signals acquired by multiple MICs in a practical scenario.

In various embodiments of the present disclosure, the noise estimation method is mainly used to estimate whether a multichannel audio signal acquired by a MIC array within an intelligent device is a noise signal. The intelligent device can include, but not limited to, an intelligent washing machine, an intelligent cleaning robot, an intelligent air conditioner, an intelligent television, an intelligent sound box, an intelligent alarm clock, an intelligent lamp, a smart watch, intelligent wearable glasses, a smart band, a smart phone, a smart tablet computer and the like.

On the other aspect, a sound collection function of the intelligent device can be realized by the MIC array, the MIC array is an array formed by multiple MICs at different spatial positions that are arranged in a certain shape rule and is a device configured to perform spatial sampling on an audio signal propagated in the space, and the acquired audio signal includes spatial position information thereof. According to a topological structure of the MIC array, the MIC array can be a one-dimensional array and a two-dimensional planar array, and can also be a spherical three-dimensional array, etc.

In some embodiments of the disclosure, the multiple MICs of the MIC array within the intelligent device can present, for example, a linear arrangement and a circular arrangement. In a voice recognition technology, it is important for noise estimation which is a basis for noise suppression and interference suppression. At present, the noise estimation technology is generally accurate only for processing of the single-channel audio signals, and it is hard to process multichannel audio signals in a practical scenario. In order to solve this problem, the present disclosure proposed an audio signal noise estimation method for implementing noise signal recognition, particularly noise recognition for a multichannel audio signal, during audio processing, so as to improve accuracy of the noise estimation.

FIG. 1 is a flowchart illustrating an audio signal noise estimation method according to some embodiments of the present disclosure. The method can be applied to a MIC array including multiple MICs. As shown in FIG. 1, the method can include the following operations.

In operation 11, for multiple preset sampling points, a noise SRP value of an audio signal acquired by the MIC array at each preset sampling point within a preset noise sampling period is determined to obtain a noise SRP multidimensional vector including the multiple noise SRP values. Each noise SRP value corresponds to a respective one of the multiple preset sampling points.

The preset sampling points can be predetermined. The SRP value can be determined based on an audio signal acquired by the MIC array. The SRP multidimensional vector is a multidimensional vector including the SRP values corresponding to the multiple preset sampling points respectively.

Before introduction of a specific implementation mode of operation 11, the preset sampling point used in the present disclosure will be simply introduced at first.

The preset sampling point is a virtual point in space, and it does not exist actually but is an auxiliary point for audio signal processing. A position of each preset sampling point in the multiple preset sampling points can be determined by a person. The multiple preset sampling points can be disposed in a one-dimensional array arrangement, or in a two-dimensional planar arrangement or in a three-dimensional spatial arrangement, etc.

In some embodiments, the positions of the multiple preset sampling points can be randomly determined in different spatial directions relative to the MIC array.

In some other embodiments, the position of each preset sampling point can be determined based on a position of each MIC within the MIC array (or the MIC array). For example, a center of the position of each MIC in the MIC array is taken as a central position, and the preset sampling points are arranged in the vicinity of the central position.

In some embodiments of the disclosure, rasterization processing can be performed on a space centered on the MIC array, and positions of various raster points obtained by the rasterization processing are determined as the positions of the preset sampling points.

For example, circular rasterization in a two-dimensional space or spherical rasterization in a three-dimensional space is performed with a geometric center of the MIC array as a raster center and with different lengths (for example, different lengths that are randomly selected and lengths increased by equal spacing relative to the raster center) as a radius.

In another example, square rasterization in the two-dimensional space is performed with the geometric center of the MIC array as the raster center, with the raster center as a square center and with different lengths (for example, different lengths that are randomly selected and lengths increased by equal spacing relative to the raster center) as a side length of the square.

In another example, cubic rasterization in the three-dimensional space is performed with the geometric center of the MIC array as the raster center, with the raster center as a cube center and with different lengths (for example, different lengths that are randomly selected and lengths increased by equal spacing relative to the raster center) as a side length of the cube.

In another example, circular rasterization in the two-dimensional space is performed with the geometric center of the MIC array as the raster center, with the raster center as a circle center and with a length as a circle radius, such that the multiple preset sampling points are uniformly distributed on a circle.

In another example, spheroidal rasterization in the three-dimensional space is performed with the geometric center of the MIC array as the raster center, with the raster center as a spheroid center and with a length as a spheroid radius, such that the multiple preset sampling points are uniformly distributed on a spherical surface of a spheroid.

In an example, the position of the preset sampling point can be determined according to the following formula (3):

$$(S_x^k)^2+(S_y^k)^2+(S_z^k)^2=r^2 \ (1\leq k\leq n) \tag{3}$$

where $(S_x^k, S_y^k, S_z^k)$ is a coordinate of the k-th preset sampling point $S^k$ in a three-dimensional rectangular coordinate system, n is the number of the preset sampling points, and r is a preset distance. The three-dimensional rectangular coordinate system can be established based on the position of each MIC within the MIC array. In the example, one or more preset sampling points are positioned on a sphere with an origin of the three-dimensional rectangular coordinate system as a sphere center and with the preset distance r as a radius. In some embodiments of the disclosure, the preset distance r can be 1, and then the preset sampling point is positioned on a unit sphere centered on the origin of the three-dimensional rectangular coordinate system.

Based on the above example, values of $S_x^k$, $S_y^k$ or $S_z^k$ of the coordinate corresponding to the preset sampling point $S^k$ can further be defined to select the preset sampling point more accurately. In some embodiments of the disclosure, based on the example, if it is set that r=1, it can further be defined that $0\leq S_z^k\leq 0.3$ to reduce the number of the preset sampling points and thus data processing efficiency is improved.

In addition, besides the manners shown in the example, positions of one or more preset sampling points can also be determined in another manner. There are no limits made thereto in the present disclosure.

Based on the determined multiple preset sampling points, the noise SRP value corresponding to each preset sampling point within the preset noise sampling period can be determined for the multiple preset sampling points. From the above, the noise SRP value can be determined based on the audio signal acquired by the MIC array.

The following will describe on how to determine the SRP value according to some embodiments of the present disclosure.

In a pickup process, each MIC of the MIC array can acquire an audio signal, and the signal acquired by each MIC is further processed and then synthesized to obtain a processing result. An audio signal is non-stationary as a whole but can be considered to be locally stationary. It is necessary to input a stationary signal during audio signal processing, an audio signal within an acquisition time period in a time domain is usually required to be framed, namely split into many segments in the time domain. It is generally believed that signals within a range of 10 ms to 30 ms are relatively stationary, and thus a length of one frame can be set within the range of 10 ms to 30 ms, for example, 20 ms. Then, a windowing processing is performed for continuity of the framed signal. In some embodiments, a hamming window can be windowed during audio signal processing. In addition, Fourier transform processing is used for transforming a time-domain signal into a corresponding frequency-domain signal. In some embodiments, a frequency-domain signal can be obtained by Short-Time Fourier Transform (STFT) in audio signal processing. Based on the above principles, upon reception of an audio signal acquired by the MIC array, the audio signal is preprocessed at first to improve accuracy and stability of the audio signal processing. In a preprocessing stage for the audio signal, framing, windowing and Fourier transform processing can be performed on the audio signal to obtain a frequency-domain signal of each frame of signal.

After the audio signal acquired by the MIC array is preprocessed, the frequency-domain signal, corresponding to each frame (each frame obtained by framing), of each MIC in the MIC array can be obtained.

For the obtained frequency-domain signal, corresponding to each frame (each frame obtained by framing), of each MIC, SRP values corresponding to the frame at the multiple preset sampling points can be determined according to the following manner.

In a first step, for each preset sampling point, a delay difference between a delay from the preset sampling point to one of every two MICs in the multiple MICs and a delay from the preset sampling point to the other of every two MICs is calculated according to the positions of the multiple MICs and the position of each preset sampling point.

In a second step, the SRP value of the frame at each preset sampling point is determined according to the delay difference and the frequency-domain signal of the frame.

In some embodiments of the disclosure, for the first step, the delay difference $\tau_{ij}^{k}$ between a delay from the k-th preset sampling point $S^k$ to the i-th MIC and a delay of the k-th preset sampling point $S^k$ to the j-th MIC can be calculated according to the following formula (4):

$$\tau_{ij}^{k} = \frac{f_s * d}{c} \tag{4}$$

where fs is a sampling rate, d is a distance difference between a distance from the preset sampling point $S^k$ to the i-th MIC and a distance from the preset sampling point to the j-th MIC, c is speed of sound, $1 \le i \ne j \le M$, M is the number of the MICs in the MIC array, and d can be obtained through the following formula (5):

$$d = \sqrt{(S_x^k - P_x^i)^2 + (S_y^k - P_y^i)^2 + (S_z^k - P_z^i)^2} - \sqrt{(S_x^k - P_x^j)^2 + (S_y^k - P_y^j)^2 + (S_z^k - P_z^j)^2} \tag{5}$$

In some embodiments of the disclosure, for the second step, the SRP value $SRP^{S^k}$ corresponding to the k-th preset sampling point $S^k$ can be calculated according to the following formula (6):

$$SRP^{S^k} = \sum_{i=1}^{M-1} \sum_{j=i+1}^{M} R_{ij}(\tau_{ij}^{S^k}) \tag{6}$$

where M is the number of the MICs in the MIC array. $R_{ij}(\tau)$ can be calculated through the following formula (7):

$$R_{ij}(\tau) = \int_{-\infty}^{+\infty} \frac{X^i(\omega)X^j(\omega)^*}{|X^i(\omega)X^j(\omega)^*|} e^{j\omega\tau} d\omega \tag{7}$$

In the formula, $X^i(\omega)$ represents frequency-domain signal, corresponding to frame, of the i-th MIC, $X^j(\omega)$ represents the frequency-domain signal, corresponding to the frame, of the j-th MIC, and "*" represents conjugation.

Each delay difference $\tau_{ij}^{k}$ corresponding to the preset sampling point $S^k$ is substituted into $R^{ij}(\tau)$ in combination with the formula to obtain the SRP value $SRP^{S^k}$ corresponding to the preset sampling point $S^k$ in the frame. Moreover, for each preset sampling point, the SRP value corresponding to the preset sampling point in the frame can be calculated in such a manner, thereby obtaining the SRP value of the frame at each preset sampling point in the multiple preset sampling points.

The specific implementation mode of operation 11 will now be described. In operation 11, for the multiple preset sampling points, the noise SRP value of the audio signal acquired by the MIC array at each preset sampling point within the preset noise sampling period is determined to obtain the noise SRP multidimensional vector including the multiple noise SRP values. Each of the multiple noise SRP values corresponds to a respective one of the multiple preset sampling points.

The multiple preset sampling points can be selected with reference to the above introductions. Then, for the multiple preset sampling points, the noise SRP value corresponding to the MIC array at each preset sampling point within the preset noise sampling period is determined.

The MIC array can perform noise sampling within a preset noise sampling period for noise estimation. The preset noise sampling period can be a specific period (for example, 8:00~9:00 every day); or the preset noise sampling period can be a predetermined duration with periodicity (for example, acquiring for 1 minute every hour). The preset noise sampling period can be a period related to working time of the MIC array (for example, first five minutes after the MIC array starts working); or the preset noise sampling period can be a predetermined number of audio frames prior to a present frame (for example, 200 frames prior to the present frame).

Since the preset noise sampling period can include multiple audio frames (also called noise frames herein), preprocessing can be performed on the audio signal according to the manner as introduced above to obtain a frequency-domain signal, corresponding to each noise frame, of each MIC in the MIC array.

Figure 2A:
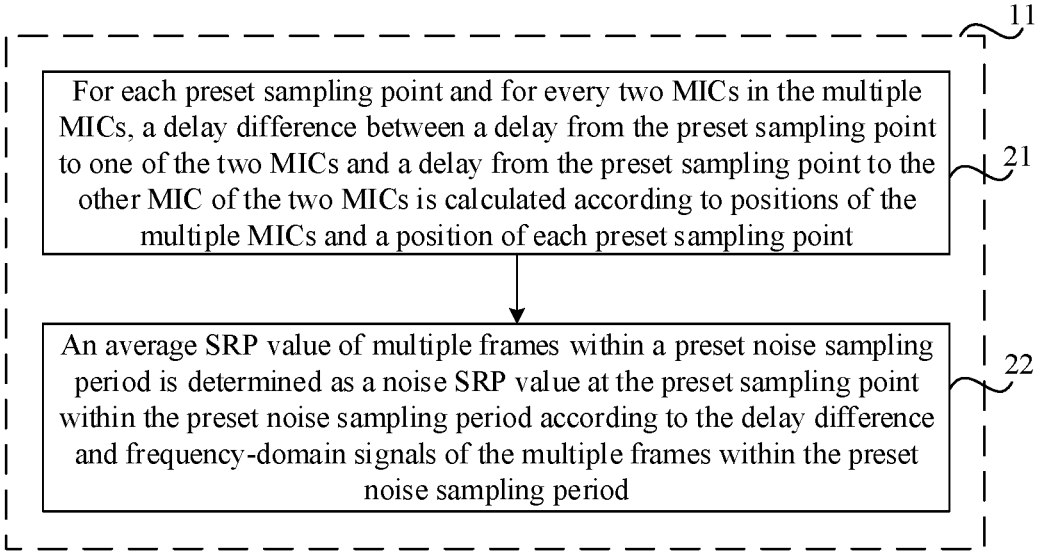
FIG. 2A is a flowchart of an exemplary implementation mode of determining a noise SRP value in an audio signal noise estimation method according to the present disclosure.

In some embodiments, the noise SRP value of the MIC array at each of the multiple preset sampling points within the preset noise sampling period can be obtained according to the SRP value determination manner as introduced above, and thus multiple SRP values corresponding to the multiple noise frames within the preset noise sampling period are respectively obtained. Therefore, the operation 11 can include the following operations as shown in FIG. 2A.

In operation 21, for each preset sampling point and for every two MICs of the multiple MICs, a delay difference between a delay from the preset sampling point to one of the two MICs and a delay from the preset sampling point to the other MIC of the two MICs is calculated according to positions of the multiple MICs and a position of the preset sampling point.

In some embodiments of the disclosure, the delay difference between the delay from the preset sampling point to one of the two MICs and the delay from the preset sampling point to the other MIC of the two MICs, for each preset sampling point and for every two MICs of the multiple MICs, can be calculated according to the formulae (4) and (5).

In operation 22, according to the delay difference and frequency-domain signals of the multiple frames within the preset noise sampling period, an average SRP value of multiple frames within the preset noise sampling period is determined as the noise SRP value the preset sampling point within the preset noise sampling period.

A SRP value of each of the multiple frames within the preset noise sampling period at each preset sampling point can be determined according to the delay difference and the frequency-domain signals of the multiple frames within the preset noise sampling period, and the noise SRP value at each preset sampling point is determined according to the SRP value each of the multiple frames.

In some embodiments, when the SRP value of each of the multiple frames within the preset noise sampling period are determined, the SRP value of each of the multiple frames within the preset sampling period at each preset sampling point can be calculated according to the formulae (6) and (7).

According to operation 22, for each preset sampling point, the SRP values of the multiple frames within the preset noise sampling period at the preset sampling point can be averaged, and the obtained average SRP value is determined as the noise SRP value at the preset sampling point within the preset noise sampling period.

In addition, a manner for determining the noise SRP value is not limited to the averaging manner provided in operation 22. In some embodiments, according to some embodiments of the disclosure, for each preset sampling point, a maximum value in the SRP values of the multiple frames within the preset noise sampling period at the preset sampling point can be determined as the noise SRP value at the preset sampling point within the preset noise sampling period. For another example, for each preset sampling point, a minimum value in the SRP values of the multiple frames within the preset noise sampling period at the preset sampling point can be determined as the noise SRP value at the preset sampling point within the preset noise sampling period. For another example, after the maximum value and the minimum value are deducted from the SRP values of the multiple frames within the preset noise sampling period at the preset sampling point, the noise SRP value is determined by averaging the maximum value and the minimum value in the averaging manner.

The SRP multidimensional vector is a multidimensional vector including the SRP values corresponding to the multiple preset sampling points respectively, and can be represented as $SRP=[SRP^{S^1}, SRP^{S^2}, \ldots, SRP^{S^n}]$. In some embodiments of the disclosure, if there are totally 120 preset sampling points, the SPR multidimensional vector is a 120-dimensional vector.

Therefore, the noise SRP multidimensional vector can be determined according to the noise SRP value at each of the multiple preset sampling points within the preset noise sampling period above. In some embodiments of the disclosure, if there are totally three preset sampling points and the noise SRP values corresponding to the preset sampling points within the preset noise sampling period are value1, value2 and value3, respectively, then the noise SRP multidimensional vector SRPnoise can be represented as follows:

$$SRP_{noise}=[value1,value2,value3].$$

In operation 12, a present frame SRP value for a present frame of an audio signal acquired by the MIC array at each preset sampling point is determined to obtain a present frame SRP multidimensional vector including the multiple present frame SRP values. Each present frame SRP value corresponds to a respective one of the multiple preset sampling points.

The present frame is a frame that noise estimation is to be performed on. The audio signal acquired by the MIC array can be processed according to the preprocessing manner described above to obtain an audio signal of the multiple frames. If noise estimation is to be performed on a frame in the audio signal, the frame can be determined as the present frame.

Figure 2B:
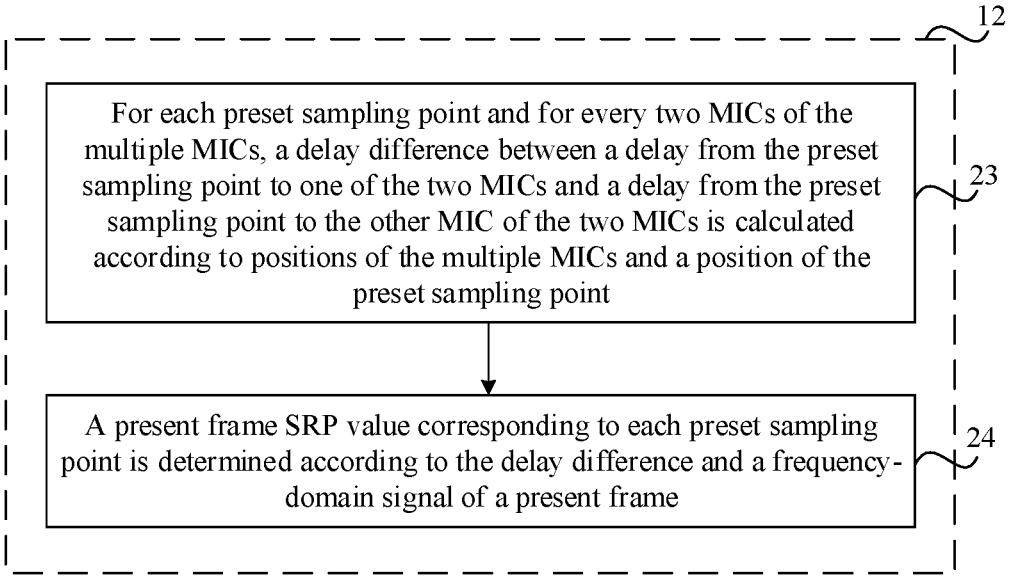
FIG. 2B is a flowchart of an exemplary implementation mode of determining a present frame SRP value in an audio signal noise estimation method according to the present disclosure.

In some embodiments, the present frame SRP multidimensional vector can be determined with reference to the above manner for determining the noise SRP multidimensional vector. Then, operation 12 can include the following operations as shown in FIG. 2B.

In operation 23, for each preset sampling point and for every two MICs of the multiple MICs, the delay difference between a delay from the preset sampling point to one of the two MICs and a delay from the preset sampling point to the other MIC of the two MICs is calculated according to the positions of the multiple MICs and the position of the preset sampling point.

In some embodiments of the disclosure, the delay difference between a delay from the preset sampling point to one of the two MICs and a delay from the preset sampling point to the other MIC of the two MICs can be calculated according to the formulae (4) and (5).

In operation 24, the present frame SRP value corresponding to each preset sampling point is determined according to the delay difference and a frequency-domain signal of the present frame.

In some embodiments of the disclosure, the present frame SRP value corresponding to each preset sampling point can be calculated according to the formulae (6) and (7).

Then, the present frame SRP multidimensional vector is determined according to the present frame SRP value corresponding to each preset sampling point.

Back to FIG. 1, in operation 13, it is determined whether the audio signal acquired by the MIC array in the present frame is a noise signal according to the present frame SRP multidimensional vector and the noise SRP multidimensional vector.

SRP has a spatial feature and represents a magnitude of a correlation of various points in the space. In a practical scenario, a target sound source and noise source in the space are located at different positions, a noise exists for a long time, and a non-noise signal corresponding to the target sound source appears at intervals. Therefore, audio signals in the space can be considered to exist in two situations: existence of only noise signals, or coexistence of noise signals and non-noise signals. However, the two situations correspond to different SRP. In view of this, it can be determined whether an audio signal is a noise signal through change of the SRP. Therefore, it can be determined whether the audio signal acquired by the MIC array in the present frame is a noise signal according to SRP of the present frame.

Figure 3:
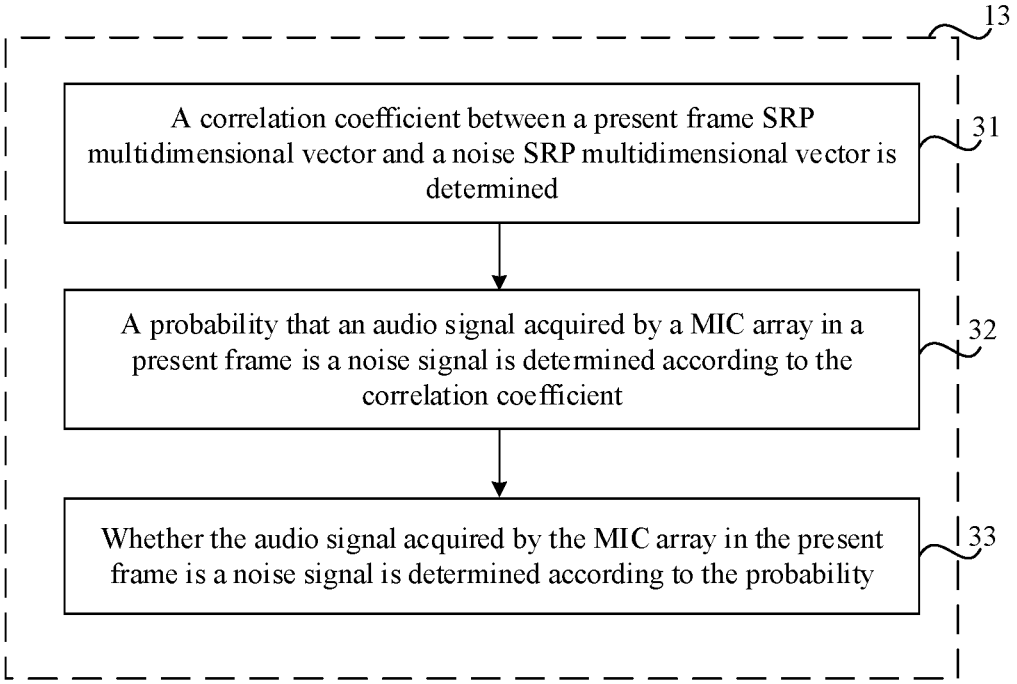
FIG. 3 is a flowchart of an exemplary implementation mode of determining whether an audio signal acquired by a MIC array in a present frame is a noise signal according to a present frame SRP multidimensional vector and a noise SRP multidimensional vector in an audio signal noise estimation method according to the present disclosure.

In some embodiments, as shown in FIG. 3, the operation 13 can include the following operations.

In operation 31, a correlation coefficient between the present frame SRP multidimensional vector and the noise SRP multidimensional vector is determined.

In some embodiments of the disclosure, the correlation coefficient feature_cur between the present frame SRP multidimensional vector and the noise SRP multidimensional vector can be calculated through the following formula (8):

$$\text{feature_cur} = \frac{\text{Cov(SRP_noise, SRP_cur)}}{\sqrt{\text{Var[SRP_noise]Var[SRP_cur]}}} \tag{8}$$

where SRP_noise is the noise SRP multidimensional vector, and SRP_cur is the present frame SRP multidimensional vector.

In operation 32, a probability that the audio signal acquired by the MIC array in the present frame is a noise signal is determined according to the correlation coefficient.

The operation 32 can be considered as mapping of the correlation coefficient to a numerical interval [0, 1].

In some embodiments of the disclosure, a correspondence between a correlation coefficient and a probability value can be pre-established, and the probability can be obtained according to the correlation coefficient and the correspondence.

For another example, the probability Prob_cur that the audio signal acquired by the MIC array in the present frame is a noise signal can be calculated through the following formula (9):

$$\text{Prob_cur}=0.5*(\tanh(\text{widthPrior}*(\text{feature_cur}-\text{feature-Thresh}))+1.0) \quad (9)$$

where widthPrior and feartureThresh are adjustable parameters, which can be adjusted according to a practical requirement.

In operation 33, it is determined whether the audio signal acquired by the MIC array in the present frame is a noise signal according to the probability.

If the probability that the audio signal acquired by the MIC array in the present frame is a noise signal is greater than a preset probability threshold, it is determined that the audio signal acquired by the MIC array in the present frame is a noise signal.

If the probability that the audio signal acquired by the MIC array in the present frame is a noise signal is less than or equal to the preset probability threshold, it is determined that the audio signal acquired by the MIC array in the present frame is a non-noise signal.

The preset probability threshold can be set by a user. In some embodiments, the preset probability threshold can be 0.56.

In some embodiments, after the correlation coefficient between the present frame SRP multidimensional vector and the noise SRP multidimensional vector is obtained, a smoothing operation can also be executed on the obtained correlation coefficient, and the smoothed correlation coefficient is used for determination of the probability in operation 32, so as to improve the data processing accuracy. In some embodiments, smoothing of the correlation coefficient feature_cur can be implemented according to the following formula (10):

$$\text{feature_opt}=(1-\alpha)*\text{feature}_0+\alpha*\text{feature_cur} \quad (10)$$

where feature_opt is the smoothed correlation coefficient, $\text{feature}_0$ is a first initial value, $\alpha$ is a first smoothing coefficient, and $0\leq\alpha\leq1$. The first initial value and the first smoothing coefficient can be set by the user. In some embodiments, the first initial value can be 0.5. In the formula (10), weight of the calculated correlation coefficient (feature_cur) and the first initial value are adjusted by using the first smoothing coefficient $\alpha$ to obtain the smoothed correlation coefficient (feature_opt). In the example, the calculated correlation coefficient is directly determined as a final correlation coefficient without any smoothing operation, which can correspond to the condition that $\alpha=1$ in the smoothing calculation formula (10).

In some embodiments, after the probability that the audio signal acquired by the MIC array in the present frame is a noise signal is obtained, the smoothing operation can further be executed on the obtained probability, and the smoothed probability is adopted for noise estimation in operation 33, so as to improve the data processing accuracy. In some embodiments, smoothing of the probability Prob_cur can be implemented according to the following formula (11):

$$\text{Prob_opt}=(1-\beta)*\text{Prob}_0+\beta*\text{Prob_cur} \quad (11)$$

where Prob_cur is the smoothed probability, Prob0 is a second initial value, $\beta$ is a second smoothing coefficient, and $0\leq\beta\leq1$. The second initial value and the second smoothing coefficient can be set by the user. In some embodiments, the second initial value can be 1. In the formula (11), weight of the calculated probability (Prob_cur) and the second initial value are adjusted by using the second smoothing coefficient $\beta$ to obtain the smoothed probability (Prob_opt). In the example, the calculated probability value is directly determined as a final probability without any smoothing operation, which can correspond to the condition that $\beta=1$ in the smoothing calculation formula (11).

Through the technical solution, the noise SRP value of the MIC array at each preset sampling point within the preset noise sampling period is determined to obtain the noise SRP multidimensional vector, the present frame SRP value for the present frame of the audio signal acquired by the MIC array at each preset sampling point is determined to obtain the present frame SRP multidimensional vector, and it is determined whether the audio signal acquired by the MIC in the present frame is a noise signal according to the present frame SRP multidimensional vector and the noise SRP multidimensional vector. The present frame SRP multidimensional vector for the audio signal acquired by the MIC array is calculated, the present frame SRP multidimensional vector is compared with the noise SRP multidimensional vector, and recognition of a noise implemented by using change of an SRP feature, so that noise recognition accuracy can be improved, and recognition of noise in multichannel voices can be implemented with high accuracy and high robustness.

Figure 4:
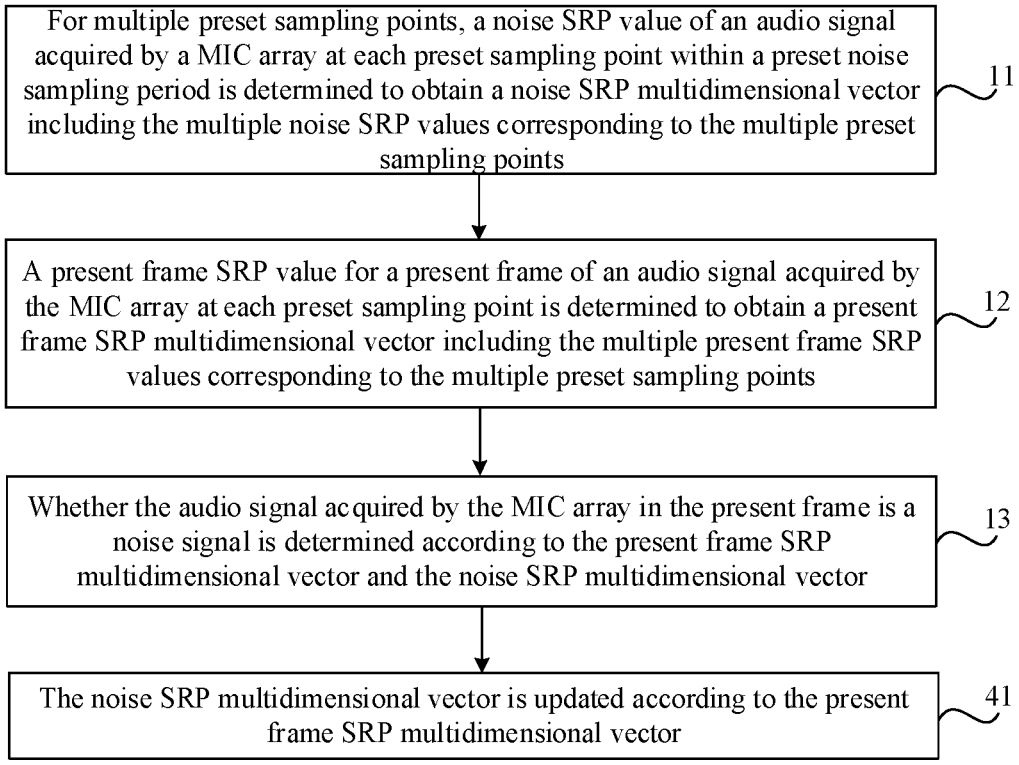
FIG. 4 is a flowchart illustrating an audio signal noise estimation method according to another exemplary embodiment.

FIG. 4 is a flowchart illustrating an audio signal noise estimation method according to another exemplary embodiment. As shown in FIG. 4, besides the operations shown in FIG. 1, the method can further include the following operations.

In operation 41, the noise SRP multidimensional vector is updated according to the present frame SRP multidimensional vector.

In some embodiments, the operation 41 can include the following actions:

if it is determined that the audio signal acquired by the MIC array in the present frame is a noise signal, the noise SRP multidimensional vector is updated according to the present frame SRP multidimensional vector and a first preset coefficient; and if it is determined that the audio signal acquired by the MIC array in the present frame is a non-noise signal, the noise SRP multidimensional vector is updated according to the present frame SRP multidimensional vector and a second preset coefficient.

The second preset coefficient is different from the first preset coefficient.

If it is determined in operation 13 that the audio signal acquired by the MIC array in the present frame is a noise signal, the noise SRP multidimensional vector is updated according to the present frame SRP multidimensional vector and the first preset coefficient.

In some embodiments of the disclosure, the noise SRP multidimensional vector can be updated through the following formula (1):

$$\text{SRP_noise}(t+1)=(1-\gamma_1)*\text{SRP_noise}(t)+\gamma_1*\text{SRP_}cur \quad (1)$$

where $\gamma1$ is the first preset coefficient and can be set according to the practical requirement or with reference to experiences, $0\leq\gamma_1\leq1$, SRP_cur is the present frame SRP multidimensional vector, SRP_noise(t) is the noise SRP multidimensional vector before updating, and SRP_noise(t+1) is the updated noise SRP multidimensional vector.

If it is determined in operation 13 that the audio signal acquired by the MIC array in the present frame is a non-noise signal, the noise SRP multidimensional vector is updated according to the present frame SRP multidimensional vector and the second preset coefficient.

In some embodiments of the disclosure, the noise SRP multidimensional vector can be updated through the following formula (2):

$$SRP_noise(t+1)=(1-\gamma_2)*SRP_noise(t)+\gamma_2*SRP_cur \quad (2)$$

where γ2 is the second preset coefficient and can be set according to the practical requirement or set empirically from experience, $0\leq\gamma_2\leq1$, SRP_cur is the present frame SRP multidimensional vector, SRP_noise(t) is the noise SRP multidimensional vector before updating, and SRP_noise(t+1) is the updated noise SRP multidimensional vector.

In a possible situation, $$\gamma_2 = \frac{\gamma_1}{4}.$$

Herein, both the first preset coefficient and the second preset coefficient are coefficients representing a smoothing degree, different values thereof mean that: when the present frame is a noise frame, an updating speed is higher; and when the present frame is a non-noise frame, the updating speed is lower.

Through the above manner, the noise SRP multidimensional vector can be updated in combination with a practical application situation so as to further improve accuracy of noise signal recognition in a subsequent recognition process.

Figure 5:
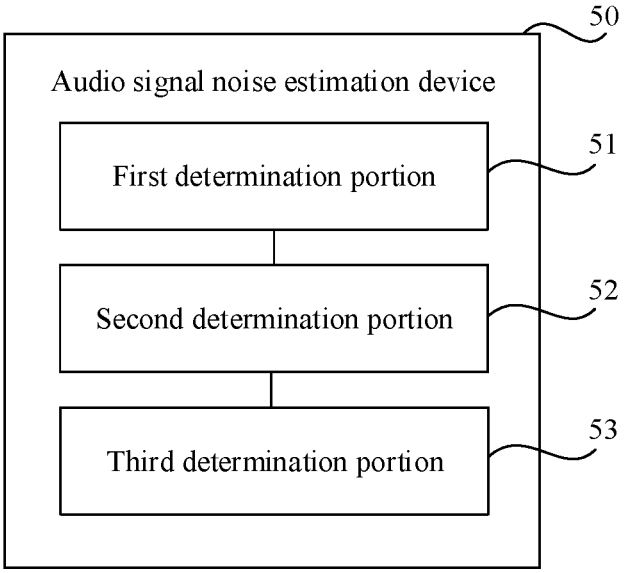
FIG. 5 is a block diagram of an audio signal noise estimation device according to some embodiments of the present disclosure.

FIG. 5 is a block diagram of an audio signal noise estimation device according to some embodiments of the present disclosure. The device can be applied to a MIC array including multiple MICs. As shown in FIG. 5, the device 50 can include: a first determination portion 51, a second determination portion 52 and a third determination portion 53.

The first determination portion 51 is configured to determine, for multiple preset sampling points, a noise SRP value of an audio signal acquired by the MIC array at each preset sampling point within a preset noise sampling period to obtain a noise SRP multidimensional vector including the multiple noise SRP values. Each of the multiple noise SRP value corresponds to a respective one of the multiple preset sampling points.

The second determination portion 52 is configured to determine a present frame SRP value for a present frame of an audio signal acquired by the MIC array at each preset sampling point to obtain a present frame SRP multidimensional vector including the multiple present frame SRP values. Each of the multiple present frame SRP values corresponds to a respective one of the multiple preset sampling points.

The third determination portion 53 is configured to determine whether the audio signal acquired by the MIC array in the present frame is a noise signal according to the present frame SRP multidimensional vector and the noise SRP multidimensional vector.

In some embodiments, the third determination portion 53 includes: a first determination sub-portion, a second determination sub-portion, and a third determination sub-portion.

The first determination sub-portion is configured to determine a correlation coefficient between the present frame SRP multidimensional vector and the noise SRP multidimensional vector.

The second determination sub-portion is configured to determine a probability that the audio signal acquired by the MIC array in the present frame is a noise signal according to the correlation coefficient.

The third determination sub-portion is configured to determine whether the audio signal acquired by the MIC array in the present frame is a noise signal according to the probability.

In some embodiments, the second determination portion 52 includes: a first calculation sub-portion and a fourth determination sub-portion.

The first calculation sub-portion is configured to calculate, for each preset sampling point and for every two MICs in the multiple MICs, a delay difference between a delay from the preset sampling point to one of the two MICs and a delay from the preset sampling point to the other MIC of the two MICs according to positions of the multiple MICs and a position of each preset sampling point.

The fourth determination sub-portion is configured to determine the present frame SRP value corresponding to each preset sampling point according to the delay difference and a frequency-domain signal of the present frame to determine the present frame SRP multidimensional vector.

In some embodiments, the first determination portion 51 includes: a second calculation sub-portion and a fifth determination sub-portion.

The second calculation sub-portion is configured to calculate, for each preset sampling point and for every two MICs in the multiple MICs, the delay difference between a delay from the preset sampling point to one of the two MICs and a delay from the preset sampling point to the other MIC of the two MICs according to the positions of the multiple MICs and the position of each preset sampling point.

The fifth determination sub-portion is configured to determine an average SRP value of multiple frames within the preset noise sampling period as the noise SRP value at each preset sampling point within the preset noise sampling period according to the delay difference and frequency-domain signals of the multiple frames within the preset noise sampling period.

In some embodiments, the device 50 further includes: an updating portion.

The updating portion is configured to after the third determination portion determines whether the audio signal acquired by the MIC array in the present frame is a noise signal, update the noise SRP multidimensional vector according to the present frame SRP multidimensional vector.

In some embodiments, the updating portion includes: a first updating sub-portion and a second updating sub-portion.

The first updating sub-portion is configured to: if it is determined that the audio signal acquired by the MIC array in the present frame is a noise signal, update the noise SRP multidimensional vector according to the present frame SRP multidimensional vector and a first preset coefficient.

The second updating sub-portion is configured to: if it is determined that the audio signal acquired by the MIC array in the present frame is a non-noise signal, update the noise SRP multidimensional vector according to the present frame SRP multidimensional vector and a second preset coefficient. The second preset coefficient is different from the first preset coefficient.

In some embodiments, the first updating sub-portion is configured to update the noise SRP multidimensional vector according to the following formula (1):

$$SRP_noise(t+1)=(1-\gamma_1)*SRP_noise(t)+\gamma_1*SRP_cur \quad (1)$$

where γ1 is the first preset coefficient, SRP_cur is the present frame SRP multidimensional vector, SRP_noise(t) is the noise SRP multidimensional vector prior to updating, and SRP_noise(t+1) is the updated noise SRP multidimensional vector.

In some embodiments, the second updating sub-portion is configured to update the noise SRP multidimensional vector according to the following formula (2):

$$SRP_noise(t+1)=(1-\gamma_2)*SRP_noise(t)+\gamma_2*SRP_cur \quad (2)$$

where γ2 is the second preset coefficient, SRP_cur is the present frame SRP multidimensional vector, SRP_noise(t) is the noise SRP multidimensional vector prior to updating, and SRP_noise(t+1) is the updated noise SRP multidimensional vector.

With respect to the device in the above embodiment, the specific manners for performing operations of individual portions have been described in detail in the embodiment of the method and will not be elaborated herein.

The present disclosure also provides a computer-readable storage medium, in which a computer program instruction is stored. The program instruction, when being executed by a processor, causes the processor to implement the operations of the audio signal noise estimation method provided in the present disclosure.

Figure 6:
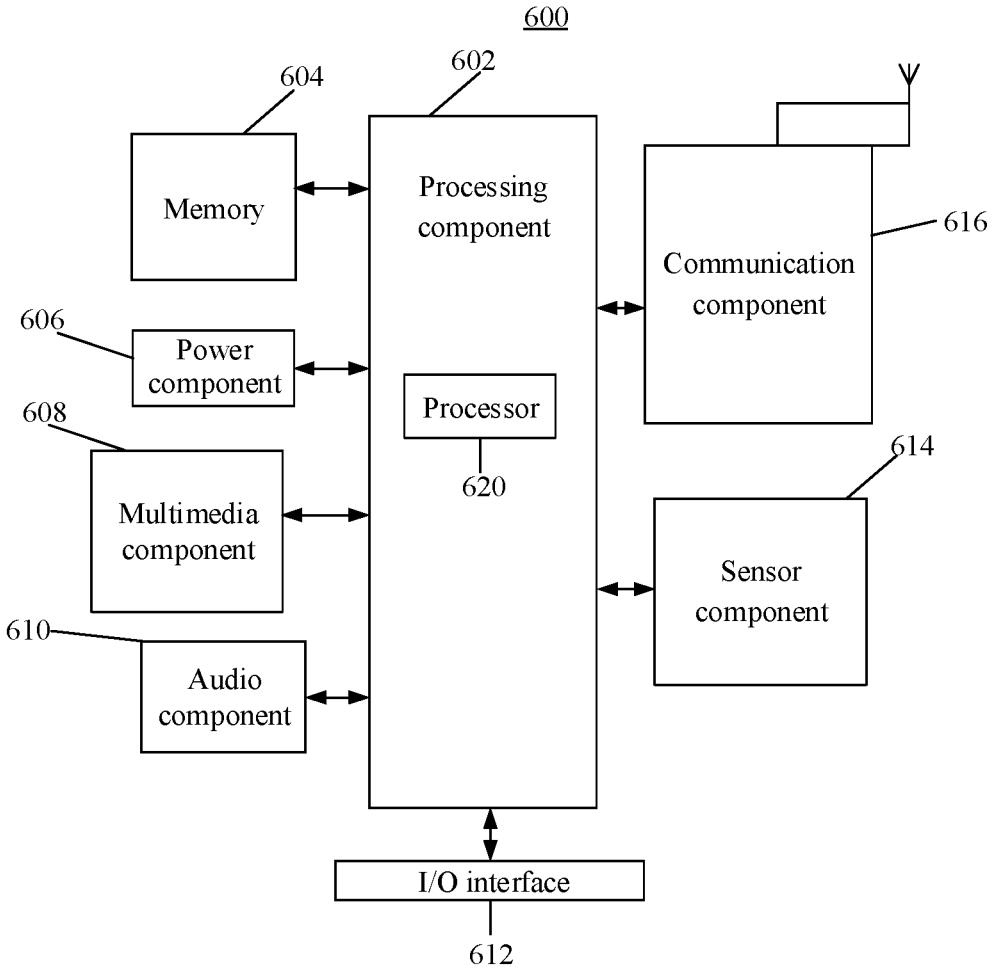
FIG. 6 is a block diagram of an audio signal noise estimation device according to another exemplary embodiment.

FIG. 6 is a block diagram of an audio signal noise estimation device according to some embodiments of the present disclosure. For example, the device 600 can be a mobile phone, a computer, a digital broadcast terminal, a messaging device, a gaming console, a tablet, a medical device, exercise equipment, a personal digital assistant and the like.

Referring to FIG. 6, the device 600 can include one or more of the following components: a processing component 602, a memory 604, a power component 606, a multimedia component 608, an audio component 610, an Input/Output (I/O) interface 612, a sensor component 614, and a communication component 616.

The processing component 602 typically controls overall operations of the device 600, such as operations associated with display, telephone calls, data communications, camera operations, and recording operations. The processing component 602 can include one or more processors 620 to execute instructions to perform all or part of the operations in the audio signal noise estimation method. Moreover, the processing component 602 can include one or more portions which facilitate interaction between the processing component 602 and the other components. For instance, the processing component 602 can include a multimedia portion to facilitate interaction between the multimedia component 608 and the processing component 602.

The memory 604 is configured to store various types of data to support the operation of the device 600. Examples of such data include instructions for any application programs or methods operated on the device 600, contact data, phonebook data, messages, pictures, video, etc. The memory 604 can be implemented by any type of volatile or non-volatile memory devices, or a combination thereof, such as an Electrically Erasable Programmable Read-Only Memory (EEPROM), an Erasable Programmable Read-Only Memory (EPROM), a Programmable Read-Only Memory (PROM), a Read-Only Memory (ROM), a magnetic memory, a flash memory, and a magnetic or optical disk.

The power component 606 provides power for various components of the device 600. The power component 606 can include a power management system, one or more power supplies, and other components associated with generation, management and distribution of power for the device 600.

The multimedia component 608 includes a screen providing an output interface between the device 600 and a user. In some embodiments, the screen can include a Liquid Crystal Display (LCD) and a Touch Panel (TP). In some embodiments, organic light-emitting diode (OLED) or other types of displays can be employed. If the screen includes the TP, the screen can be implemented as a touch screen to receive an input signal from the user. The TP includes one or more touch sensors to sense touches, swipes and gestures on the TP. The touch sensors can not only sense a boundary of a touch or swipe action but also detect a duration and pressure associated with the touch or swipe action. In some embodiments, the multimedia component 608 includes a front camera and/or a rear camera. The front camera and/or the rear camera can receive external multimedia data when the device 600 is in an operation mode, such as a photographing mode or a video mode. Each of the front camera and the rear camera can be a fixed optical lens system or have focusing and optical zooming capabilities.

The audio component 610 is configured to output and/or input an audio signal. For example, the audio component 610 includes a MIC, and the MIC is configured to receive an external audio signal when the device 600 is in the operation mode, such as a call mode, a recording mode and a voice recognition mode. The received audio signal can further be stored in the memory 604 or sent through the communication component 616. In some embodiments, the audio component 610 further includes a speaker configured to output the audio signal.

The I/O interface 612 provides an interface between the processing component 602 and a peripheral interface portion, and the peripheral interface portion can be a keyboard, a click wheel, a button and the like. The button can include, but not limited to: a home button, a volume button, a starting button and a locking button.

The sensor component 614 includes one or more sensors configured to provide status assessment in various aspects for the device 600. For instance, the sensor component 614 can detect an on/off status of the device 600 and relative positioning of components, such as a display and small keyboard of the device 600, and the sensor component 614 can further detect a change in a position of the device 600 or a component of the device 600, presence or absence of contact between the user and the device 600, orientation or acceleration/deceleration of the device 600 and a change in temperature of the device 600. The sensor component 614 can include a proximity sensor configured to detect presence of an object nearby without any physical contact. The sensor component 614 can also include a light sensor, such as a Complementary Metal Oxide Semiconductor (CMOS) or Charge Coupled Device (CCD) image sensor, configured for use in an imaging application. In some embodiments, the sensor component 614 can also include an acceleration sensor, a gyroscope sensor, a magnetic sensor, a pressure sensor or a temperature sensor.

The communication component 616 is configured to facilitate wired or wireless communication between the device 600 and other equipment. The device 600 can access a communication-standard-based wireless network, such as a Wireless Fidelity (Wi-Fi) network, a 2nd-Generation (2G), 3rd-Generation (3G), $4^{th}$-Generation (4G), or $5^{th}$-Generation (5G) network or a combination thereof. In some embodiments of the present disclosure, the communication component 616 receives a broadcast signal or broadcast associated information from an external broadcast management system through a broadcast channel. In some embodiments of the present disclosure, the communication component 616 further includes a Near Field Communication (NFC) portion to facilitate short-range communication. For example, the NFC portion can be implemented based on a Radio Frequency Identification (RFID) technology, an Infrared Data Association (IrDA) technology, an Ultra-WideBand (UWB) technology, a Bluetooth (BT) technology and another technology.

In some embodiments of the present disclosure, the device 600 can be implemented by one or more Application Specific Integrated Circuits (ASICs), Digital Signal Processors (DSPs), Digital Signal Processing Devices (DSPDs), Programmable Logic Devices (PLDs), Field Programmable Gate Arrays (FPGAs), controllers, micro-controllers, microprocessors or other electronic components, and is configured to execute the audio signal noise estimation method.

In some embodiments of the present disclosure, there is also provided a non-transitory computer-readable storage medium including an instruction, such as the memory 604 including an instruction, and the instruction can be executed by the processor 620 of the device 600 to implement the audio signal noise estimation method. For example, the non-transitory computer-readable storage medium can be a ROM, a Compact Disc Read-Only Memory (CD-ROM), a magnetic tape, a floppy disc, an optical data storage device and the like.

Another exemplary embodiment also provides a computer program product, which includes a computer program executable for a programmable device, the computer program including a code part executed by the programmable device to execute the audio signal noise estimation method.

Figure 7:
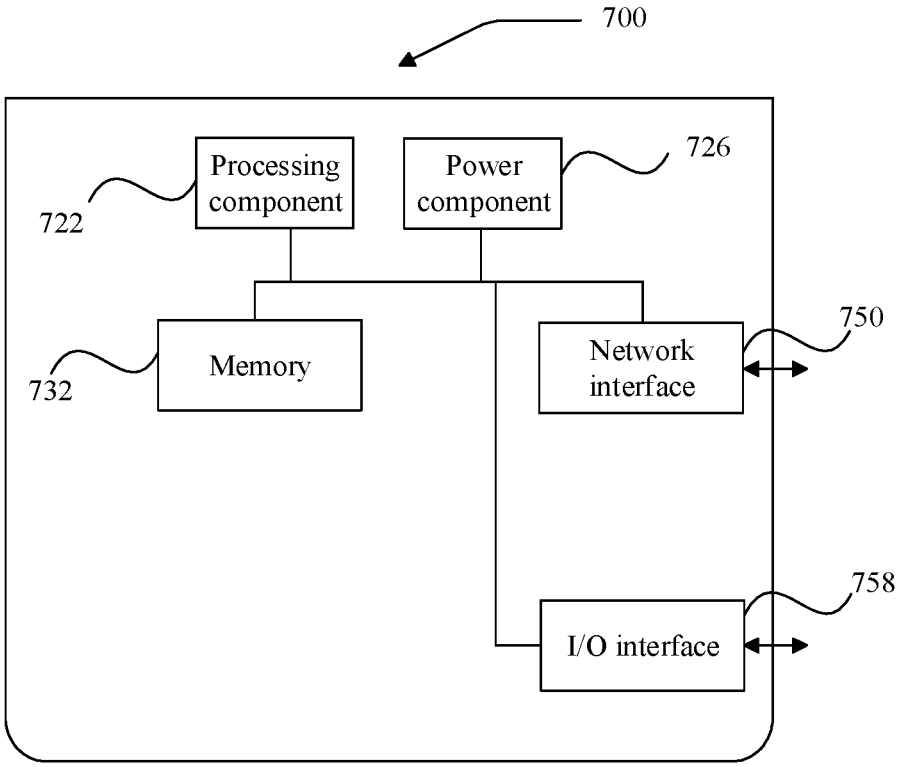
FIG. 7 is a block diagram of an audio signal noise estimation device according to yet another exemplary embodiment.

FIG. 7 is a block diagram of an audio signal noise estimation device, according to some embodiments of the present disclosure. For example, the device 700 can be provided as a server. Referring to FIG. 7, the device 700 includes a processing component 722, further including one or more processors, and a memory resource represented by a memory 732, configured to store an instruction executable for the processing component 722, for example, an application program. The application program stored in the memory 732 can include one or more than one portion of which each corresponds to a set of instructions. In addition, the processing component 722 is configured to execute the instruction to implement the audio signal noise estimation method.

The device 700 can further include a power component 726 configured to execute power management of the device 700, a wired or wireless network interface 750 configured to connect the device 700 to a network and an I/O interface 758. The device 700 can be operated based on an operating system stored in the memory 732, for example, Windows Server™, Mac OS X™, Unix™, Linux™, FreeBSD™ or the like.

Various embodiments of the present disclosure can have one or more of the following advantages.

Through the technical solutions, the noise SRP value of the audio signal acquired by the MIC array at each preset sampling point within the preset noise sampling period is determined for the multiple preset sampling points to obtain the noise SRP multidimensional vector, the present frame SRP value of the MIC array for the present frame of the audio signal at each preset sampling point is determined to obtain the present frame SRP multidimensional vector. Furthermore, it is determined whether the audio signal acquired by the MIC in the present frame is a noise signal according to the present frame SRP multidimensional vector and the noise SRP multidimensional vector.

The present frame SRP multidimensional vector for the audio signal acquired by the MIC array is calculated, the present frame SRP multidimensional vector is compared with the noise SRP multidimensional vector, so as to implement recognition of a noise by using change of an SRP feature, and thus accuracy of noise recognition can be improved, and recognition of noise in multichannel voices can be implemented with high accuracy and strong robustness.

In the description of the present disclosure, the terms "one embodiment," "some embodiments," "example," "specific example," or "some examples," and the like can indicate a specific feature described in connection with the embodiment or example, a structure, a material or feature included in at least one embodiment or example. In the present disclosure, the schematic representation of the above terms is not necessarily directed to the same embodiment or example.

Moreover, the particular features, structures, materials, or characteristics described can be combined in a suitable manner in any one or more embodiments or examples. In addition, various embodiments or examples described in the specification, as well as features of various embodiments or examples, can be combined and reorganized.

In some embodiments, the control and/or interface software or app can be provided in a form of a non-transitory computer-readable storage medium having instructions stored thereon is further provided. For example, the non-transitory computer-readable storage medium can be a magnetic tape, a floppy disk, optical data storage equipment, a flash drive such as a USB drive or an SD card, and the like.

Implementations of the subject matter and the operations described in this disclosure can be implemented in digital electronic circuitry, or in computer software, firmware, or hardware, including the structures disclosed herein and their structural equivalents, or in combinations of one or more of them. Implementations of the subject matter described in this disclosure can be implemented as one or more computer programs, i.e., one or more portions of computer program instructions, encoded on one or more computer storage medium for execution by, or to control the operation of, data processing apparatus.

Alternatively, or in addition, the program instructions can be encoded on an artificially-generated propagated signal, e.g., a machine-generated electrical, optical, or electromagnetic signal, which is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them.

Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, drives, or other storage devices). Accordingly, the computer storage medium can be tangible.

The operations described in this disclosure can be implemented as operations performed by a data processing apparatus on data stored on one or more computer-readable storage devices or received from other sources.

The devices in this disclosure can include special purpose logic circuitry, e.g., an FPGA (field-programmable gate array), or an ASIC (application-specific integrated circuit). The device can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The devices and execution environment can realize various different computing model infrastructures, such as web services, distributed computing, and grid computing infrastructures.

A computer program (also known as a program, software, software application, app, script, or code) can be written in any form of programming language, including compiled or interpreted languages, declarative or procedural languages, and it can be deployed in any form, including as a standalone program or as a portion, component, subroutine, object, or other portion suitable for use in a computing environment.

A computer program can, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more portions, sub-programs, or portions of code). A computer program can be deployed to be executed on one computer or on multiple computers that are located at one site or distributed across multiple sites and interconnected by a communication network.

The processes and logic flows described in this disclosure can be performed by one or more programmable processors executing one or more computer programs to perform actions by operating on input data and generating output. The processes and logic flows can also be performed by, and apparatus can also be implemented as, special purpose logic circuitry, e.g., an FPGA, or an ASIC.

Processors or processing circuits suitable for the execution of a computer program include, by way of example, both general and special purpose microprocessors, and any one or more processors of any kind of digital computer. Generally, a processor will receive instructions and data from a read-only memory, or a random-access memory, or both. Elements of a computer can include a processor configured to perform actions in accordance with instructions and one or more memory devices for storing instructions and data.

Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few.

Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented with a computer and/or a display device, e.g., a VR/AR device, a head-mount display (HMD) device, a head-up display (HUD) device, smart eyewear (e.g., glasses), a CRT (cathode-ray tube), LCD (liquid-crystal display), OLED (organic light emitting diode), or any other monitor for displaying information to the user and a keyboard, a pointing device, e.g., a mouse, trackball, etc., or a touch screen, touch pad, etc., by which the user can provide input to the computer.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components.

The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

While this specification contains many specific implementation details, these should not be construed as limitations on the scope of any claims, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination.

Moreover, although features can be described above as acting in certain combinations and even initially claimed as such, one or more features from a claimed combination can in some cases be excised from the combination, and the claimed combination can be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing can be advantageous. Moreover, the separation of various system components in the implementations described above should not be understood as requiring such separation in all implementations, and it should be understood that the described program components and systems can generally be integrated together in a single software product or packaged into multiple software products.

As such, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing can be utilized.

It is intended that the specification and embodiments be considered as examples only. Other embodiments of the disclosure will be apparent to those skilled in the art in view of the specification and drawings of the present disclosure. That is, although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the example embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

It should be understood that "a plurality" or "multiple" as referred to herein means two or more. "And/or," describing the association relationship of the associated objects, indicates that there may be three relationships, for example, A and/or B may indicate that there are three cases where A exists separately, A and B exist at the same time, and B exists separately. The character "/" generally indicates that the contextual objects are in an "or" relationship.

In the present disclosure, it is to be understood that the terms "lower," "upper," "under" or "beneath" or "underneath," "above," "front," "back," "left," "right," "top," "bottom," "inner," "outer," "horizontal," "vertical," and other orientation or positional relationships are based on example orientations illustrated in the drawings, and are merely for the convenience of the description of some embodiments, rather than indicating or implying the device or component being constructed and operated in a particular orientation. Therefore, these terms are not to be construed as limiting the scope of the present disclosure.

Moreover, the terms "first" and "second" are used for descriptive purposes only and are not to be construed as indicating or implying a relative importance or implicitly indicating the number of technical features indicated. Thus, elements referred to as "first" and "second" may include one or more of the features either explicitly or implicitly. In the description of the present disclosure, "a plurality" indicates two or more unless specifically defined otherwise.

In the present disclosure, a first element being "on" a second element may indicate direct contact between the first and second elements, without contact, or indirect geometrical relationship through one or more intermediate media or layers, unless otherwise explicitly stated and defined. Similarly, a first element being "under," "underneath" or "beneath" a second element may indicate direct contact between the first and second elements, without contact, or indirect geometrical relationship through one or more intermediate media or layers, unless otherwise explicitly stated and defined.

Some other embodiments of the present disclosure can be available to those skilled in the art upon consideration of the specification and practice of the various embodiments disclosed herein. The present application is intended to cover any variations, uses, or adaptations of the present disclosure following general principles of the present disclosure and include the common general knowledge or conventional technical means in the art without departing from the present disclosure. The specification and examples can be shown as illustrative only, and the true scope and spirit of the disclosure are indicated by the following claims.

The invention claimed is:

1. An audio signal noise estimation method, applied to a Microphone (MIC) array comprising multiple MICs, the method comprising:

determining, for multiple preset sampling points, a noise steered response power (SRP) value of an audio signal acquired by the MIC array at each preset sampling point within a preset noise sampling period, to obtain a noise SRP multidimensional vector comprising multiple noise SRP values, each of the multiple noise SRP values corresponding to a respective one of the multiple preset sampling points;

determining a present frame SRP value for a present frame of an audio signal acquired by the MIC array at each preset sampling point, to obtain a present frame SRP multidimensional vector comprising the multiple present frame SRP values, each of the multiple present frame SRP values corresponding to a respective one of the multiple preset sampling points; and determining whether the audio signal acquired by the MIC array in the present frame is a noise signal according to the present frame SRP multidimensional vector and the noise SRP multidimensional vector.

2. The method of claim 1, wherein the determining whether the audio signal acquired by the MIC array in the present frame is a noise signal according to the present frame SRP multidimensional vector and the noise SRP multidimensional vector comprises:

determining a correlation coefficient between the present frame SRP multidimensional vector and the noise SRP multidimensional vector;

determining, according to the correlation coefficient, a probability that the audio signal acquired by the MIC array in the present frame is a noise signal; and determining whether the audio signal acquired by the MIC array in the present frame is a noise signal according to the probability.

3. The method of claim 1, wherein the determining the present frame SRP value for the present frame of the audio signal acquired by the MIC array at each preset sampling point comprises:

for each preset sampling point and for every two MICs in the multiple MICs, calculating a delay difference between a delay from the preset sampling point to one of the two MICs and a delay from the preset sampling point to the other MIC of the two MICs according to positions of the multiple MICs and a position of each preset sampling point; and determining a present frame SRP value corresponding to each preset sampling point according to the delay difference and a frequency-domain signal of the present frame.

4. The method of claim 1, wherein the determining the noise SRP value of the audio signal acquired by the MIC array at each preset sampling point within the preset noise sampling period comprises:

for each preset sampling point and for every two MICs of the multiple MICs, calculating a delay difference between a delay from the preset sampling point to one of the two MICs and a delay from the preset sampling point to the other MIC of the two MICs according to positions of the multiple MICs and a position of each preset sampling point; and determining an average SRP value of multiple frames within the preset noise sampling period as the noise SRP value at each preset sampling point within the preset noise sampling period according to the delay difference and frequency-domain signals of the multiple frames within the preset noise sampling period.

5. The method of claim 1, after the determining whether the audio signal acquired by the MIC array in the present frame is a noise signal, the method further comprising:

updating the noise SRP multidimensional vector according to the present frame SRP multidimensional vector.

6. The method of claim 5, wherein the updating the noise SRP multidimensional vector according to the present frame SRP multidimensional vector comprises:

responsive to determining that the audio signal acquired by the MIC array in the present frame is a noise signal, updating the noise SRP multidimensional vector according to the present frame SRP multidimensional vector and a first preset coefficient; and responsive to determining that the audio signal acquired by the MIC array in the present frame is a non-noise signal, updating the noise SRP multidimensional vector according to the present frame SRP multidimensional vector and a second preset coefficient, wherein the second preset coefficient is different from the first preset coefficient.

7. The method of claim 6, wherein the updating the noise SRP multidimensional vector according to the present frame SRP multidimensional vector and the first preset coefficient comprises:

updating the noise SRP multidimensional vector according to the following formula (1):

$$\text{SRP_noise}(t+1)=(1-\gamma_1)*\text{SRP_noise}(t)+\gamma_1*\text{SRP_cur} \quad (1)$$

where $\gamma_1$ is the first preset coefficient, SRP_cur is the present frame SRP multidimensional vector, SRP_noise(t) is the noise SRP multidimensional vector before updating, and SRP_noise(t+1) is the updated noise SRP multidimensional vector.

8. The method of claim 6, wherein the updating the noise SRP multidimensional vector according to the present frame SRP multidimensional vector and the second preset coefficient comprises:

updating the noise SRP multidimensional vector according to the following formula (2):

$$\text{SRP_noise}(t+1)=(1-\gamma_2)*\text{SRP_noise}(t)+\gamma_2*\text{SRP_cur} \quad (2)$$

where $\gamma_2$ is the second preset coefficient, SRP_cur is the present frame SRP multidimensional vector, SRP_noise(t) is the noise SRP multidimensional vector before updating, and SRP_noise(t+1) is the updated noise SRP multidimensional vector.

9. The method of claim 1, wherein before the determining, for multiple preset sampling points, a SRP value of an audio signal acquired by the MIC array at each preset sampling point within a preset noise sampling period, to obtain a noise SRP multidimensional vector comprising multiple noise SRP values, the method further comprising:

acquiring the audio signal including the noise signal.

10. An audio signal noise estimation device, comprising:

a processor; and a memory configured to store an instruction executable by the processor, wherein the processor is configured to:

determine, for multiple preset sampling points, a noise steered response power (SRP) value of an audio signal acquired by a Microphone (MIC) array at each preset sampling point within a preset noise sampling period to obtain a noise SRP multidimensional vector comprising the multiple noise SRP values, each of the multiple noise SRP values corresponding to a respective one of the multiple preset sampling points;

determine a present frame SRP value for a present frame of an audio signal acquired by the MIC array at each preset sampling point to obtain a present frame SRP multidimensional vector comprising the multiple present frame SRP values, each of the multiple present frame SRP values corresponding to a respective one of the multiple preset sampling points; and determine whether an audio signal acquired by the MIC array in the present frame is a noise signal according to the present frame SRP multidimensional vector and the noise SRP multidimensional vector.

11. The device of claim 10, wherein the processor is configured to:

determine a correlation coefficient between the present frame SRP multidimensional vector and the noise SRP multidimensional vector;

determine, according to the correlation coefficient, a probability that the audio signal acquired by the MIC array in the present frame is a noise signal; and determine whether the audio signal acquired by the MIC array in the present frame is a noise signal according to the probability.

12. The device of claim 10, wherein the processor is configured to:

for each preset sampling point and for every two MICs in the multiple MICs, calculate a delay difference between a delay from the preset sampling point to one of the two MICs and a delay from the preset sampling point to the other MIC of the two MICs according to positions of the multiple MICs and a position of each preset sampling point; and determine a present frame SRP value corresponding to each preset sampling point according to the delay difference and a frequency-domain signal of the present frame.

13. The device of claim 10, wherein the processor is configured to:

for each preset sampling point and for every two MICs of the multiple MICs, calculate a delay difference between a delay from the preset sampling point to one of the two MICs and a delay from the preset sampling point to the other MIC of the two MICs according to positions of the multiple MICs and a position of each preset sampling point; and determine an average SRP value of multiple frames within the preset noise sampling period as the noise SRP value at each preset sampling point within the preset noise sampling period according to the delay difference and frequency-domain signals of the multiple frames within the preset noise sampling period.

14. The device of claim 10, wherein the processor is configured to:

update the noise SRP multidimensional vector according to the present frame SRP multidimensional vector.

15. The device of claim 14, wherein the processor is configured to:

responsive to determining that the audio signal acquired by the MIC array in the present frame is a noise signal, update the noise SRP multidimensional vector according to the present frame SRP multidimensional vector and a first preset coefficient; and responsive to determining that the audio signal acquired by the MIC array in the present frame is a non-noise signal, update the noise SRP multidimensional vector according to the present frame SRP multidimensional vector and a second preset coefficient, wherein the second preset coefficient is different from the first preset coefficient.

16. The device of claim 15, wherein the processor is configured to:

update the noise SRP multidimensional vector according to the following formula (1):

$$SRP_noise(t+1)=(1-\gamma_1)*SRP_noise(t)+\gamma_1*SRP_cur \quad (1)$$

where $\gamma_1$ is the first preset coefficient, SRP_cur is the present frame SRP multidimensional vector, SRP_noise(t) is the noise SRP multidimensional vector before updating, and SRP_noise(t+1) is the updated noise SRP multidimensional vector.

17. The device of claim 15, wherein the processor is configured to:

update the noise SRP multidimensional vector according to the following formula (2):

$$SRP_noise(t+1)=(1-\gamma_2)*SRP_noise(t)+\gamma_2*SRP_cur \quad (2)$$

where $\gamma_2$ is the second preset coefficient, SRP_cur is the present frame SRP multidimensional vector, SRP_noise(t) is the noise SRP multidimensional vector before updating, and SRP_noise(t+1) is the updated noise SRP multidimensional vector.

18. A non-transitory computer-readable storage medium, having a computer program instruction stored thereon, wherein the program instruction, when being executed by a processor, causes the processor to implement a method for audio noise estimation, the method comprising:

determining, for multiple preset sampling points, a noise steered response power (SRP) value of an audio signal acquired by a Microphone (MIC) array at each preset sampling point within a preset noise sampling period to obtain a noise SRP multidimensional vector comprising the multiple noise SRP values, each of the multiple noise SRP values corresponding to a respective one of the multiple preset sampling points;

determining a present frame SRP value for a present frame of an audio signal acquired by the MIC array at each preset sampling point to obtain a present frame SRP multidimensional vector comprising the multiple present frame SRP values, each of the multiple present frame SRP values corresponding to a respective one of the multiple preset sampling points; and determining whether an audio signal acquired by the MIC array in the present frame is a noise signal according to the present frame SRP multidimensional vector and the noise SRP multidimensional vector.

19. The non-transitory computer-readable storage medium of claim 18, wherein the determining whether the audio signal acquired by the MIC array in the present frame is a noise signal according to the present frame SRP multidimensional vector and the noise SRP multidimensional vector comprises:

determining a correlation coefficient between the present frame SRP multidimensional vector and the noise SRP multidimensional vector;

determining, according to the correlation coefficient, a probability that the audio signal acquired by the MIC array in the present frame is a noise signal; and determining whether the audio signal acquired by the MIC array in the present frame is a noise signal according to the probability.

20. The non-transitory computer-readable storage medium of claim 18, wherein the determining the present frame SRP value for the present frame of the audio signal acquired by the MIC array at each preset sampling point comprises:

for each preset sampling point and for every two MICs in the multiple MICs, calculating a delay difference between a delay from the preset sampling point to one of the two MICs and a delay from the preset sampling point to the other MIC of the two MICs according to positions of the multiple MICs and a position of each preset sampling point; and determining a present frame SRP value corresponding to each preset sampling point according to the delay difference and a frequency-domain signal of the present frame.

* * * * *